US010710831B2

(12) United States Patent
Weigold et al.

(10) Patent No.: US 10,710,831 B2
(45) Date of Patent: Jul. 14, 2020

(54) ARRANGEMENT AND METHOD FOR ALIGNING AT LEAST ONE NOTE OF VALUE

(71) Applicant: Wincor Nixdorf International GmbH, Paderborn (DE)

(72) Inventors: Richard Weigold, Bielefeld (DE); Sascha Ringel, Rietberg (DE)

(73) Assignee: Wincor Nixdorf International, GmbH, Paderborn (DE)

( * ) Notice: Subject to any disclaimer, the term of this patent is extended or adjusted under 35 U.S.C. 154(b) by 0 days.

(21) Appl. No.: 15/923,640

(22) Filed: Mar. 16, 2018

(65) Prior Publication Data

US 2018/0265319 A1 Sep. 20, 2018

(30) Foreign Application Priority Data

Mar. 17, 2017 (DE) ..... 10 2017 105 847

(51) Int. Cl.
*B65H 5/06* (2006.01)
*B65H 9/00* (2006.01)
(Continued)

(52) U.S. Cl.
CPC ..... *B65H 9/20* (2013.01); *B65H 5/062* (2013.01); *B65H 7/08* (2013.01); *B65H 7/14* (2013.01);
(Continued)

(58) Field of Classification Search
CPC ..... B65H 9/002; B65H 9/20
See application file for complete search history.

(56) References Cited

U.S. PATENT DOCUMENTS 8,437,682 B2 * 5/2013 Moriya ..... B65H 7/08 271/228
9,195,199 B2 * 11/2015 Aoki ..... G03G 15/6567
(Continued)

FOREIGN PATENT DOCUMENTS

DE 10203177 C1 7/2003
DE 102004060191 A1 6/2006
(Continued)

OTHER PUBLICATIONS

Extended European Search Report issued in the parallel European patent application; 8 pages.
(Continued)

*Primary Examiner* — Patrick Cicchino
(74) *Attorney, Agent, or Firm* — Black, McCuskey, Souers & Arbaugh, LPA

(57) ABSTRACT

An apparatus for aligning notes of value along a transport path has a note reader with a scanning line with areas detection areas there along. The scanning areas are arranged along a line orthogonally with respect to a central axis of the transport path. A first and at least one second transport elements serve to transport the note along the transport path in at least one transport direction. The transport elements each contact the note in a contact area. At least one aligning apparatus is used for aligning the note, which is arranged between the first and second transport elements and forms a section of the transport path. The note reader detects the trailing edge of the note in a first scanning area and in a second scanning area.

8 Claims, 12 Drawing Sheets

(51) Int. Cl.

| | |
|---|---|
| ***B65H 7/14*** | (2006.01) |
| ***B65H 7/08*** | (2006.01) |
| ***G07D 7/00*** | (2016.01) |
| ***G07D 11/13*** | (2019.01) |
| ***G07D 11/17*** | (2019.01) |
| ***G07D 11/12*** | (2019.01) |
| ***G07D 11/23*** | (2019.01) |
| ***B65H 9/20*** | (2006.01) |
| ***G07D 11/125*** | (2019.01) |
| ***G07D 11/237*** | (2019.01) |

(52) U.S. Cl.

CPC ..... *B65H 9/002* (2013.01); *G07D 11/125* (2019.01); *G07D 11/13* (2019.01); *G07D 11/17* (2019.01); *G07D 11/237* (2019.01); *B65H 2404/1424* (2013.01); *B65H 2511/22* (2013.01); *B65H 2513/512* (2013.01); *B65H 2513/514* (2013.01); *B65H 2553/412* (2013.01); *B65H 2553/44* (2013.01); *B65H 2701/1912* (2013.01); *G07D 7/00* (2013.01); *G07D 2207/00* (2013.01); *G07D 2211/00* (2013.01)

(56) References Cited

U.S. PATENT DOCUMENTS

| | | | | |
|---|---|---|---|---|
| 9,776,819 | B2 * | 10/2017 | Yamane ..... | B65H 9/002 |
| 2011/0200341 | A1 | 8/2011 | Moriya | |
| 2013/0307213 | A1 | 11/2013 | Adachi | |
| 2015/0132016 | A1 | 5/2015 | Aoki | |
| 2016/0159598 | A1 | 6/2016 | Yamane et al. | |
| 2016/0272448 | A1 * | 9/2016 | Nakai ..... | B65H 7/10 |
| 2018/0162667 | A1 * | 6/2018 | Matsuda et al. ..... | B65H 9/00 |

FOREIGN PATENT DOCUMENTS

| | | | |
|---|---|---|---|
| DE | 102008038771 | A1 | 2/2010 |
| DE | 102008050524 | A1 | 4/2010 |
| DE | 102011000783 | A1 | 8/2012 |
| DE | 102014012867 | A1 | 3/2016 |
| JP | 2011201638 | A | 10/2011 |

OTHER PUBLICATIONS

German office action dated Nov. 6, 2017 in the corresponding German application; 11 pages.

* cited by examiner

ARRANGEMENT AND METHOD FOR ALIGNING AT LEAST ONE NOTE OF VALUE

CROSS-REFERENCE TO RELATED APPLICATIONS

This application claims priority to and the benefit of German Patent Application No. 10 2017 105 847.8, Filed 17 Mar. 2017, the contents of which are hereby incorporated by reference in their entirety.

BACKGROUND AND SUMMARY

The invention relates to an arrangement and a method for aligning notes of value during their transport along a transport path, for example within an automatic teller machine or an automatic cash safe or a cash register system. The notes of value can in particular be bank notes or checks, which are for example to be conveyed to a receiving area of a box for storing notes of value or which have been retrieved therefrom. At least one transport element serves to transport the note of value along the transport path. The transport element is driven by means of at least one first drive unit. An aligning apparatus serves to align the notes of value, in particular in order to reduce or correct a lateral offset of the note of value.

In teller machines for notes of value, such as automatic teller machines, automatic cash safes and automatic machines for dispensing and/or receiving vouchers and tickets, the notes of value received are transported from an input compartment to a receiving area and/or notes of value to be dispensed are transported from a receiving area to a dispensing compartment. The receiving area can be provided in the form of a transport box for storing and transporting the notes of value. In order to achieve as high a throughput of notes of value as possible during the transport of the notes of value and to avoid malfunctioning due to jamming of the notes of value, i.e. so-called paper jams, the usually rectangular shaped notes of value are oriented so that their longitudinal axis is arranged transversely to the transport direction. Such an orientation is also referred to as long-side-first orientation. The risk of a paper jam is particularly high in the case of used notes of value, since the stiffness of such notes of value decreases during use and contamination of the surface of the notes of value increases. In particular in the case of such used notes of value a skewed feed or skewed pulling of the notes of value during their transport may occur. As a result, the notes of value may show a lateral offset and/or an angular offset with respect to a desired target position, and they should therefore be aligned.

An apparatus for aligning notes of value is known, e.g., from document DE 10 2004 060 191 A1. In this apparatus lateral guide elements, as for example used for aligning and guiding single sheets in printers or copiers, are dispensed with. In the case of notes of value, due to their differing stiffness and the varying quality of their edges, the use of lateral guide elements would result in a misalignment and/or malfunctioning caused by paper jams. Further apparatuses for aligning notes of value are known from documents DE 10 2008 050 534 A1, DE 10 2008 038 771 A1, DE 10 2011 000 783 A1 and DE 102 03 177 C1.

It is an object of the invention to indicate an arrangement and a method for aligning a note of value by means of which it is possible to align the note of value during its transport along a transport path in a simple and reliable manner.

This object is solved by an arrangement for aligning at least one note of value having the features of patent claim 1, as well as by a method having the features of the independent method claim.

Advantageous embodiments are indicated in the dependent claims, wherein both the arrangement and the method can be developed further by means of the features of said dependent claims.

An arrangement and a method for aligning at least one note of value along a transport path having the features of the respective independent claims allow for the scanning line of a bank note reader to be used to detect at least one position at the trailing edge and preferably one position at the leading edge of the note of value. Based on this it is possible to monitor and/or control in a simple manner the path length across which the note of value has to be transported along the transport path before the aligning apparatus can commence the process of aligning the note of value. Furthermore, it is possible to control and monitor in a simple manner the path length across which the note of value can be transported along the transport path while being aligned by means of the aligning apparatus, without the note of value coming into contact with the second transport element. In this manner in particular also an angular offset of the note of value can be taken into account when determining the available aligning path length so that in the case of a note of value having a small angular offset a longer aligning path length is available than in the case of a note of value having a greater angular offset. This allows for the aligning path length to be used in an optimum manner without problems occurring due to the note of value still being in contact with the first transport element or already being in contact with the second transport element during the aligning process.

It is particularly advantageous if a control unit controls and/or monitors the transport of the note of value in the transport direction as well as the aligning apparatus commencing with the detection of the exit of the trailing edge of the note of value from the first and from the second scanning area in such a manner that the aligning apparatus commences with the aligning process only after the note of value has been transported across a preset first path length in the transport direction. Hereby it is guaranteed that the note of value is no longer in contact with the first transport element when the aligning apparatus aligns the note of value.

In this arrangement, it is advantageous if the first path length corresponds to the distance between the scanning line of the bank note reader and a contact area of the first transport element for contacting the note of value during its transport along the transport path plus a safety distance.

In other embodiments, the provision of a safety distance can be dispensed with. Hereby a simple control/monitoring of the position of the note of value can take place in such a manner that it can be guaranteed that the note of value is no longer in contact with the first transport element when it is aligned by means of the aligning apparatus.

In an advantageous embodiment the bank note reader detects the leading edge of the note of value in the first scanning area and in the second scanning area when the contact area of the second transport element on a first side of the central axis has the same lateral distance as the contact area of the first transport element and when the contact area of the second transport element on the second side of the central axis has the same lateral distance as the contact area of the first transport element. In this manner, a simple detection of the leading edge and the trailing edge by means of the scanning areas or the corresponding detection areas can be achieved when the contact areas of the first and second transport element have the same lateral distance to the central axis.

In an alternative embodiment, in which the contact areas of the second transport element have a different lateral distance to the central axis than the contact areas of the first transport element, the bank note reader detects the leading edge of the note of value in a third scanning area and a fourth scanning area, wherein the third scanning area on the first side of the central axis has the same lateral distance to the central axis of the transport path as the contact area of the second transport element, and wherein the fourth scanning area on the second side of the central axis has the same lateral distance to the central axis of the transport path as the contact are of the second transport element. This enables an exact control/monitoring of the commencing and of the termination of the aligning process by means of the aligning apparatus.

The termination of the aligning process takes generally place at the latest possible moment, at which the aligning of the note of value by the aligning apparatus has to be terminated, in order to guarantee that the note of value is moveable for alignment, in particular transversely to the transport direction. If however only a small aligning movement is needed, it is also possible to terminate the aligning process early.

It is particularly advantageous for the control unit to commence the transport of the note of value in the transport direction T1 upon the detection of the entry of the leading edge of the note of value into the first scanning area or into the second scanning area or, alternatively, into the third scanning area or the fourth scanning area, and to additionally control and/or monitor the aligning apparatus such that the aligning apparatus terminates the aligning process at the latest after the note of value has been transported across a preset second path length in the transport direction. Hereby it is guaranteed that the aligning process is reliably terminated before the note of value gets into contact with the second transport element.

It is also advantageous if the second path length corresponds to the distance between the scanning line of the bank note reader and a contact area of the second transport element for contacting the note of value during its transport along the transport path, minus a safety distance. In other embodiments, the safety distance may also be dispensed with.

It is particularly advantageous if during its transport through the aligning arrangement the note of value is additionally moveably in a transverse direction with respect to the transport direction. Hereby in particular when a lateral offset of the note of value has been detected, this lateral offset can be corrected or at least reduced.

Moreover, it is advantageous if the scanning line of the bank note reader detects at least one position of the note of value for determining a lateral offset of the note of value, wherein a control unit determines the lateral offset with respect to a preset target position. The aligning of the note of value can in particular be carried out by controlling the aligning apparatus in dependence of the determined lateral offset such that the lateral offset is reduced or corrected. The control unit can be a separate control unit of the arrangement or a control unit of the bank note reader. Hereby it is possible to use the bank note reader, which may be used in automatic teller machines for controlling the authenticity of bank notes, also for detecting the lateral offset of a note of value with respect to a target position in a simple manner. The bank note reader is used in this case both for detecting notes of value of any kind, in particular bank notes, checks, vouchers and tickets, and for detecting parameters of a note of value, such as the nominal value of a bank note or the amount of a check or note of value, and also for detecting the authenticity of the note of value, in particular the authenticity of a bank note or of a check or a voucher.

Moreover, it is advantageous, if the point of the contact area of the first transport element having the greatest lateral distance to the central axis defines the lateral distance between the first scanning area and the central axis of the transport path. It is also advantageous, if the point of the contact area of the second transport element, which has the greatest lateral distance to the central axis, defines the lateral distance between the second scanning area and the central axis of the transport path. Hereby it is guaranteed that the leading edge and the trailing edge of the note of value are detected in a scanning area with the same lateral distance with which they are subsequently contacted by the contact area of the first transport element and by the contact area of the second transport element.

Further, it is advantageous if the arrangement has at least one first drive unit which drives at least one transport element of the aligning apparatus, wherein the transport element transports the note of value in the transport direction of the transport path extending through the aligning apparatus. It is particularly advantageous if the aligning apparatus comprises additionally a second drive unit which, when activated, moves the note of value additionally transversely with respect to the transport direction. Thus, by means of the second drive unit a lateral offset of the note of value can be corrected, reduced or, if desired, produced.

In this case, it is advantageous, if the second drive unit moves, when activated, the transport element along the rotational axis thereof. Hereby a lateral movement of the note of value during its transport through the aligning apparatus can be achieved in a simple manner.

Moreover, it is advantageous, if the aligning apparatus moves the note of value during a simultaneous activation of the first drive unit and the second drive unit obliquely with respect to the transport direction. Hereby a simple alignment of the note of value can be achieved in particular in order to reduce or correct a lateral offset of the note of value.

Moreover, it is advantageous, if the transport element comprises driven and/or non-driven rotating transport rollers, transport belts, and/or cylinders. Hereby simple and robust transport elements are provided, by means of which a reliable transport of the note of value along the transport path can be secured.

In a further advantageous embodiment, the rotary direction of the transport element can be reversed so that a bidirectional passage of the notes of value through the arrangement is possible in the first transport direction and in a second transport direction opposed to the first transport direction.

It is particularly advantageous if the note of value passes through the aligning apparatus in a first transport direction, wherein the note of value during its passage is aligned in a first aligning process, and if the note of value is aligned in a second aligning process as it passes through the aligning apparatus in the second direction opposed to the first transport direction. Hereby the same note of value can be aligned repeatedly by the same aligning apparatus in a simple manner, which enables a simple correction also of more substantial displacements, in particular of a relatively great lateral offset of the note of value.

The lateral distances and the path lengths to be controlled and/or monitored are preferably determined or established in a transport plane defined by the transport path.

Both in the method and in the arrangement two aligning apparatuses can be provided subsequently along the transport path so that a first aligning process is carried out by means of the first aligning apparatus and subsequently a second aligning process is carried out by means of the second aligning apparatus.

The transport path is preferably limited by several transport elements, at least a part of which is arranged in sequence in the transport direction. Further, the transport path can be arranged between a guide element and a second guide element. In particular, the transport elements can be arranged and the guide elements can be designed such that the transport plane has an arched or curved course in the transport direction. A note of value can be transported along the transport path such that its front is arranged so that it faces a contact area of the first guide element and that its back is arranged so that it faces a contact area of the second guide element. The contact areas of the guide elements extend in a plane parallel to the transport plane, which has preferably a relatively small distance to the transport plane.

Further features and advantages of the invention become clear from the following description, which, in conjunction with the enclosed drawing figures, explains the invention in more detail with reference to various embodiments.

DETAILED DESCRIPTION

Figure 1:
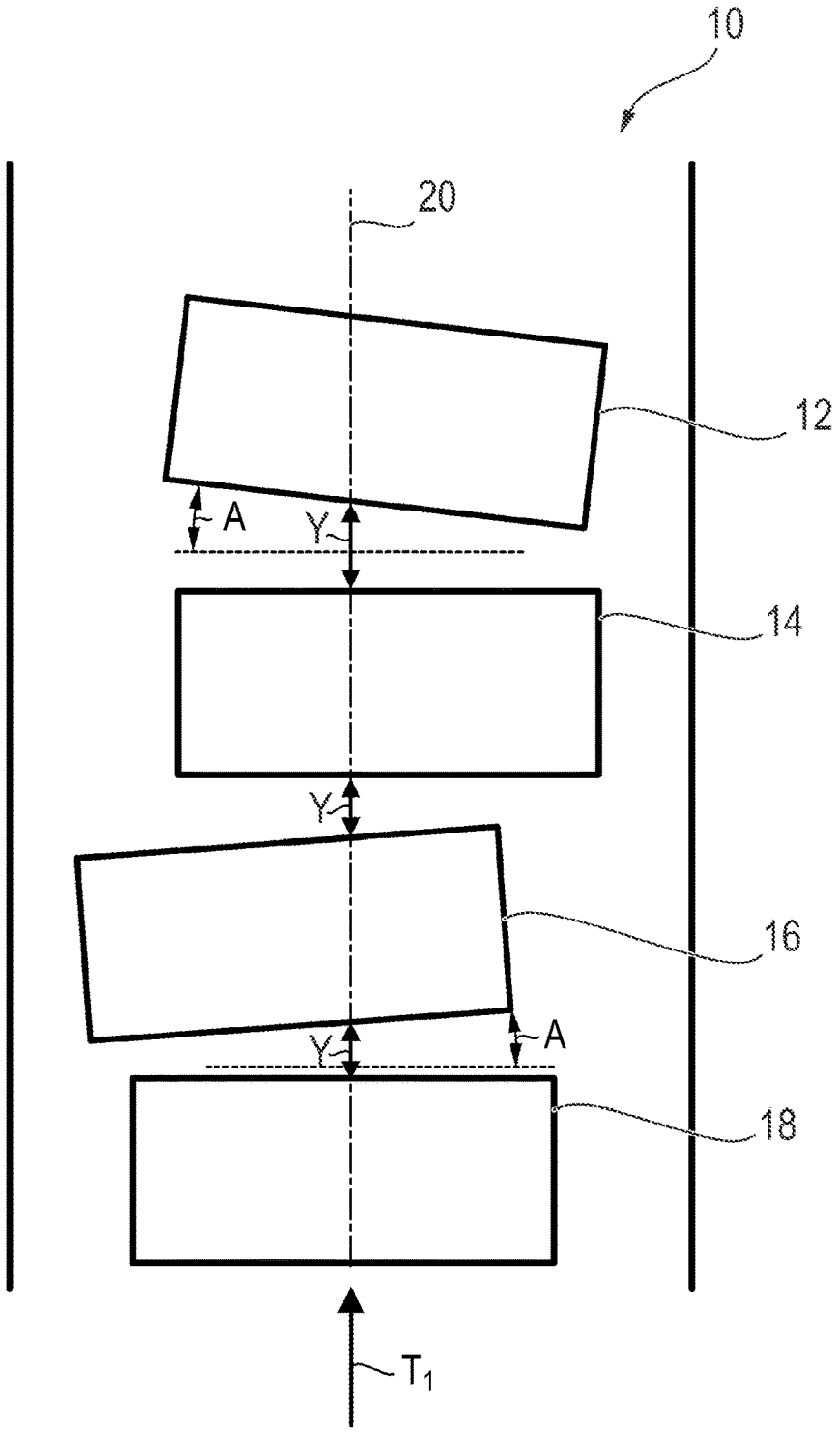
FIG. 1 shows a schematic depiction of several notes of value transported along a transport path.

In FIG. 1 a schematic view of several notes of value 12 to 18 arranged along a transport plane 10 is shown. The notes of value 12 to 18 are transported along the transport path 10 by means of transport means, which are not shown, such as rollers, cylinders, belts, and/or switch points, in the transport direction T1. The dot-dash line 20 indicates the central axis of the transport path 10. The notes of value 12 to 18 are transported in a transport plane defined by the transport path 10. In the following, such a transport plane is also designated with the reference number 10.

The notes of value 12 to 18 are supposed to have a target position relative to the transport path 10. The positions of the notes of value 12 to 18 are to only deviate within small tolerances from said target position. In the target position, the longitudinal sides of the note of value 12 to 18 are arranged orthogonally with respect to the transport direction T1 and the short central axis of the note of value 12 to 18 lies on the central axis 20 of the transport path 10. Out of the notes of value 12 to 18 shown in FIG. 1 only the note of value 18 is in the target position. The longitudinal sides of the notes of value 12 to 18 are in the present embodiment oriented at least in target positions generally transversely to the transport direction T1. Such an orientation of the longitudinal sides of the notes of value 12 to 18 orthogonally to the transport direction T1 is also referred to as long-side-first (LSF) orientation. Moreover, it is advantageous if the distance y between two subsequent notes of value 12 to 18 is the same for all notes of value. The aligning of the notes of value 12 to 18 in the target position is particularly important if the notes of value 12 to 18 are transported along the transport path 10 of an automatic teller machines or an automatic cash safe at high speed. For aligning the notes of value 12 to 16, whose position deviates from the target position, according to the invention an apparatus for aligning said notes of value 12 to 16 is provided. The design and function of the apparatus for aligning notes of value 12 to 18 will be described in detail in the following in connection with FIGS. 2 to 9. The notes of value 12 to 18 pass through the apparatus with the same transport speed as during their transport along other transport path lengths 10 within the automatic teller machine or the automatic cash register system or cash safe. In the present embodiment, the deviation of the position of the notes of value 12 to 18 from their target positions is determined by means of a note of value checking unit, which is not shown, for checking the authenticity of the notes of value 12 to 18. The notes of value checking unit is arranged upstream of the apparatus for aligning the notes of value 12 to 18 in the transport direction T1. Such a notes of value checking unit is also referred to as a bank note reader.

Deviations in the position of the notes of value 12 to 18 from the target position can occur in particular during the retrieval of notes of value 12 to 18 from note of value boxes holding badly stacked notes of value 12 to 18, when a customer inserts notes of value 12 to 18 incorrectly, and/or when notes of value 12 to 18 are pulled in a skewed position during insertion or during their transport along the transport path 10. When such deviations occur, it is necessary to move the notes of value 12 to 18 by means of the apparatus for aligning notes of value 12 to 18 into their target position in order to at least correct a detected lateral offset.

Moreover the aligning of notes of value 12 to 18 in their target position improves the alignment of the notes of value 12 to 18 in stacks for disbursing the notes of value 12 to 18 in the form of bundles or for storing the notes of value 12 to 18 as a stack, e.g. in a notes of value box. In this manner, the notes of value 12 to 18 can be stored in a space-saving way.

Moreover, the notes of value 12 to 18 can be disbursed to a customer as an orderly bundle in an appealing and convenient manner.

The note of value 14 shown in FIG. 1 is not in the target position. While its longitudinal sides are oriented orthogonally with regard to the transport direction T1, its short central axis does not lie on the central axis 20 of the transport path 10. The short central axis of the note of value 14 is displaced to the right, and thus the note of value 14 does not show an angular offset but a lateral offset. The note of value 14 therefore has to be moved to the left until the short central axis of the note of value 14 lies on the central axis 20 of the transport plane 10 in order to bring the note of value 14 into the target position.

The note of value 12 has approximately the same lateral offset transversely to the central axis 20 of the transport path 10 as the note of value 14. However, the note of value 12 is additionally turned about an angle A with regard to an orthogonal relative to the central axis 20 of the transport path 10. Such an angular deviation from the target position is also known as angular offset. The note of value 12 will have to be rotated across an angle of −A and additionally moved to the left, when seen in the transport direction T1 until the short central axis of the note of value 12 lies on the central axis 20 of the transport path 10, in order to bring the note of value 12 exactly into the target position.

The note of value 16 has an angular offset of −A and a lateral offset to the left transversely to the central axis 20 of the transport path 10 when viewed in the transport direction T1. In order to bring this note of value 16 in the target position, it has to be rotated about an angle A and moved to the right until the short axis of the note of value 16 lies on the central axis 20 of the transport plane 10. It has been found that it is sufficient in many cases to correct the lateral offset of a note of value. A correction of the angular offset is in many cases not absolutely necessary.

Figure 2:
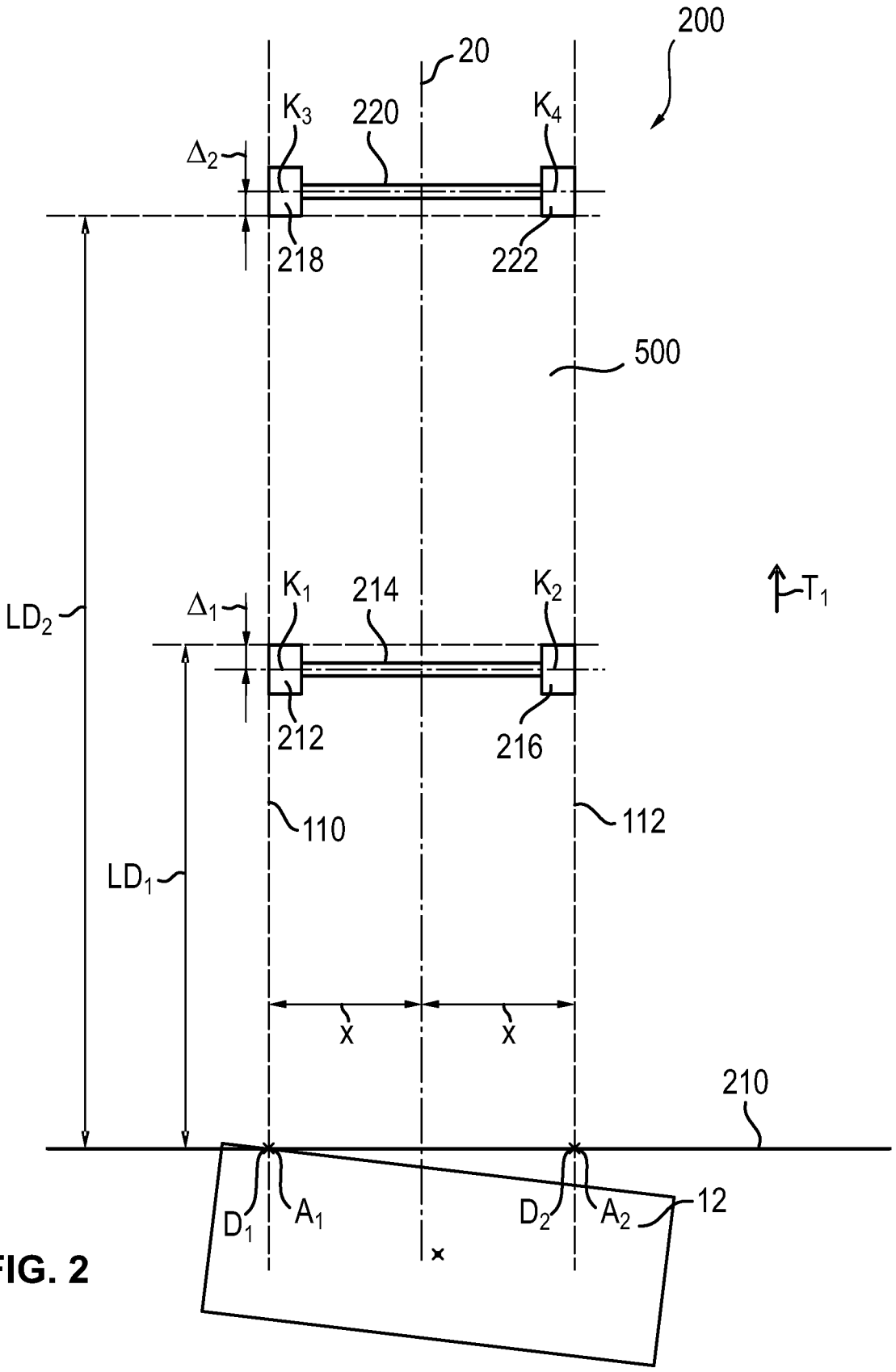
FIG. 2 shows a top view of an arrangement for aligning notes of value.

FIG. 2 shows a top view of an arrangement 200 for aligning notes of value 12 to 18. Elements, which have the same design or the same function, are denoted by the same reference numbers. The arrangement 200 comprises a bank note reader with a scanning line 210, two transport elements, and an aligning apparatus 500. The aligning apparatus 500 is arranged after the first and before the second transport element in the transport direction T1. The first transport element comprises a shaft 214 and two transport rollers 212 and 216, which contact the note of value 12 to transport it along the transport path 10 and move it towards the aligning apparatus 500. The second transport element comprises a shaft 220 and two transport rollers 218 and 222, which contact the note of value 12 to transport the note of value 12 during its transport in the transport direction T1 away from the aligning apparatus 500. The shafts 214 and 220 are driven by a drive unit, which is not shown. The distance x between the outer edges of the rollers 212, 216, 218 and 222 and the central axis 20 of the transport path 10 is the same for all the edges. The dashed lines 110 and 112 denote extensions of the outer edges of the rollers 212, 216, 218, 222 along the transport path 10.

The scanning line 210 comprises a plurality of detection areas. In FIG. 2, the position of two detection areas is denoted with the reference signs D1 and D2. The distance between D1 and the central axis 20 and the distance between D2 and the central axis 20 of the transport path 10 correspond to the distance x between the outer edges of the rollers 212, 216, 218 and 222 and the central axis 20 of the transport path 10. The detection area D1 scans a scanning area A1 in the transport plane of the transport path 10, and the detection area D2 scans a scanning area A2 in the transport plane of the transport path 10.

A control unit, which is not shown, monitors with the aid of the detection areas D1 and D2 of the scanning line 210 the scanning areas A1 and A2. As soon as the leading edge of the note of value 12 arrives at a first scanning area A1 or A2 of the bank note reader, the detection areas D1, D2 detect this event. Commencing with the first detection of the leading edge of the note of value 12 in the detection area D1 or in the detection area D2 a control and/or monitoring of the transport path covered by the leading edge of the note of value 12 in the transport direction T1 takes place. In particular the transport of the note of value 12 across a path length LD2 is monitored commencing with the detection of the leading edge of the note of value 12 in the scanning area A1, A2, preferably by controlling at least one drive unit for the transport of the note of value 12 such that the note of value 12 covers the path length LD2. After the path length LD2 has been covered, the aligning of the note of value 12 in the aligning apparatus 500 is stopped and the note of value 12 is transported away from the aligning apparatus 500 by means of the second transport element. Monitoring by means of sensors is not necessary but optionally possible.

The path length LD2 corresponds to the difference between the distance between the scanning line 210 and the contact areas K3 and K4 of the rollers 218 and 222, and a safety distance Δ2, which in the present embodiment corresponds to the radius of the rollers 218 and 222. By means of the safety distance Δ2 it is guaranteed that the aligning apparatus 500 terminates the aligning process of the note of value 12 as soon as the note of value 12 is contacted by the rollers 218 and 222. In other embodiments other, and in particular smaller, correction values can be used. In case in a special embodiment a step motor is used as a drive unit, the path length LD2 corresponds to a number of steps of the step motor. Commencing with the first detection of the leading edge of the note of value in the detection area D1, D2, the steps of the step motor during the transport of the note of value 12 along the path length LD2 can be detected. When the preset step number is reached, the aligning apparatus 500 terminates the aligning process. The aligning process carried out by the aligning apparatus 500 is hereby always terminated in time before the transport rollers 218, 220 of the second transport element contact the note of value 12.

Figure 3:
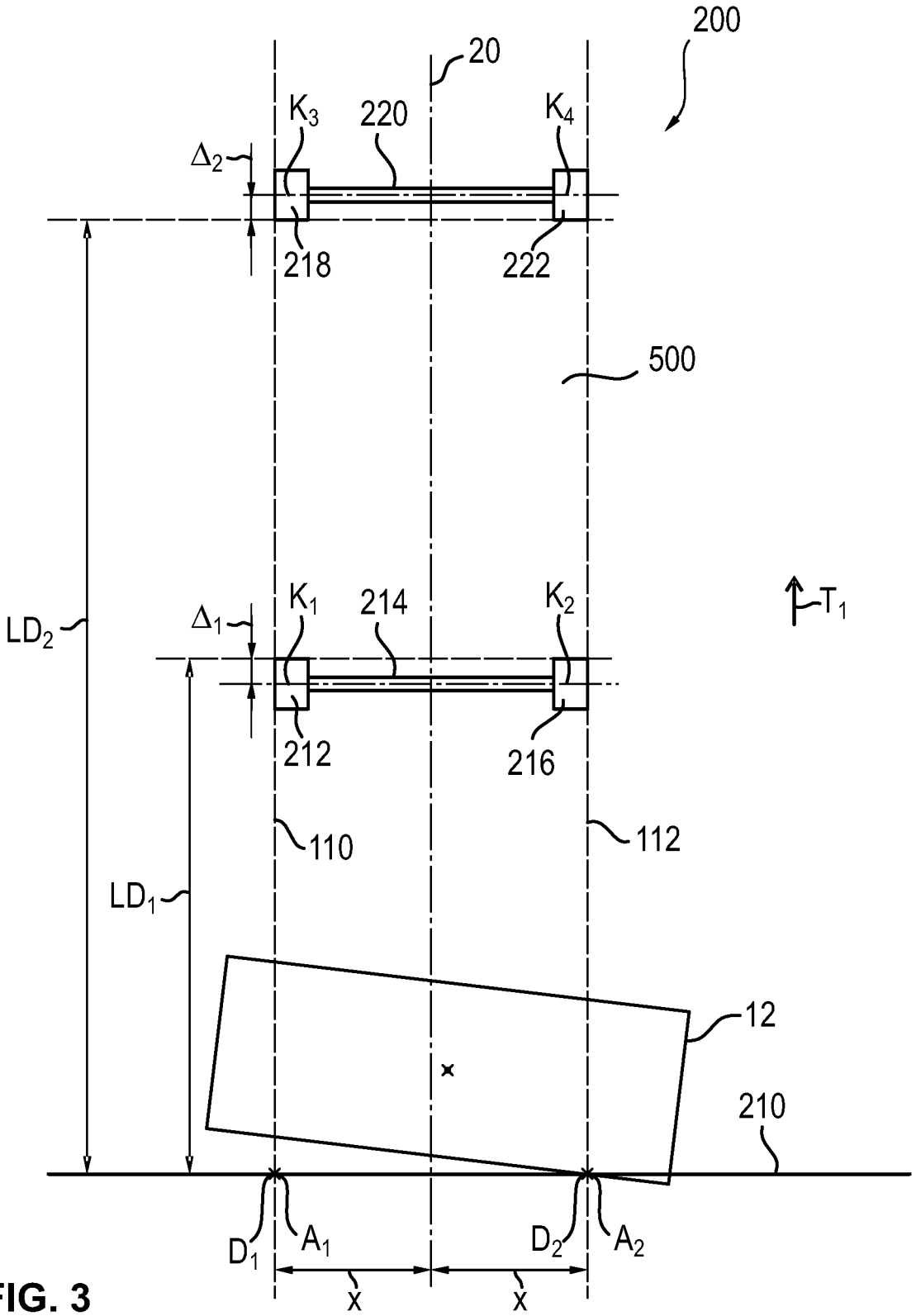
FIG. 3 shows a top view of the arrangement for aligning notes of value according to FIG. 2.

FIG. 3 shows a top view of the arrangement 200 for aligning notes of value according to FIG. 2. In the position of the note of value 12 shown in FIG. 3, the trailing edge of the note of value 12 exits the scanning area A2 of the bank note reader, and the detection area D2 of the bank note reader detects this event. In the position of the note of value 12 shown in FIG. 3 the exiting of the trailing edge of the note of value 12 from the scanning area A1 was already previously detected by the detection area D1. Commencing with the exiting of the trailing edge of the note of value 12 from the scanning area A2 control and/or monitoring of the transport path covered by the trailing edge of the note of value 12 in the transport direction T1 takes place. The control and/or monitoring of the transport path covered by the trailing edge of the note of value 12 in the transport direction T1 commences therefore only when the trailing edge has exited both scanning areas A1, A2. In particular, the transport of the note of value 12 across a path length LD1 is monitored commencing with the exit of the trailing edge of the note of value 12 from the second scanning area A2, preferably by controlling at least one drive unit for transporting the note of value 12 such that the note of value 12 covers a path length LD1. After the path length LD1 has been covered, the aligning of the note of value 12 by the aligning apparatus 500 commences.

The path length LD1 corresponds to the sum of a distance between the scanning line 210 and the contact areas K1 and K2 of the rollers 212 and 216, and a safety distance .DELTA.1, which in the present embodiment corresponds to the radius of the rollers 212 and 216. By means of the safety distance .DELTA.1, it is guaranteed that the note of value 12 is no longer in contact with the rollers 212 and 216 when the aligning commences in the aligning apparatus 500, so that the aligning apparatus 500 can commence the aligning process of the note of value 12 without problems. In other embodiments other, and in particular smaller, safety distances .DELTA.1 can be used.

Figure 4A:
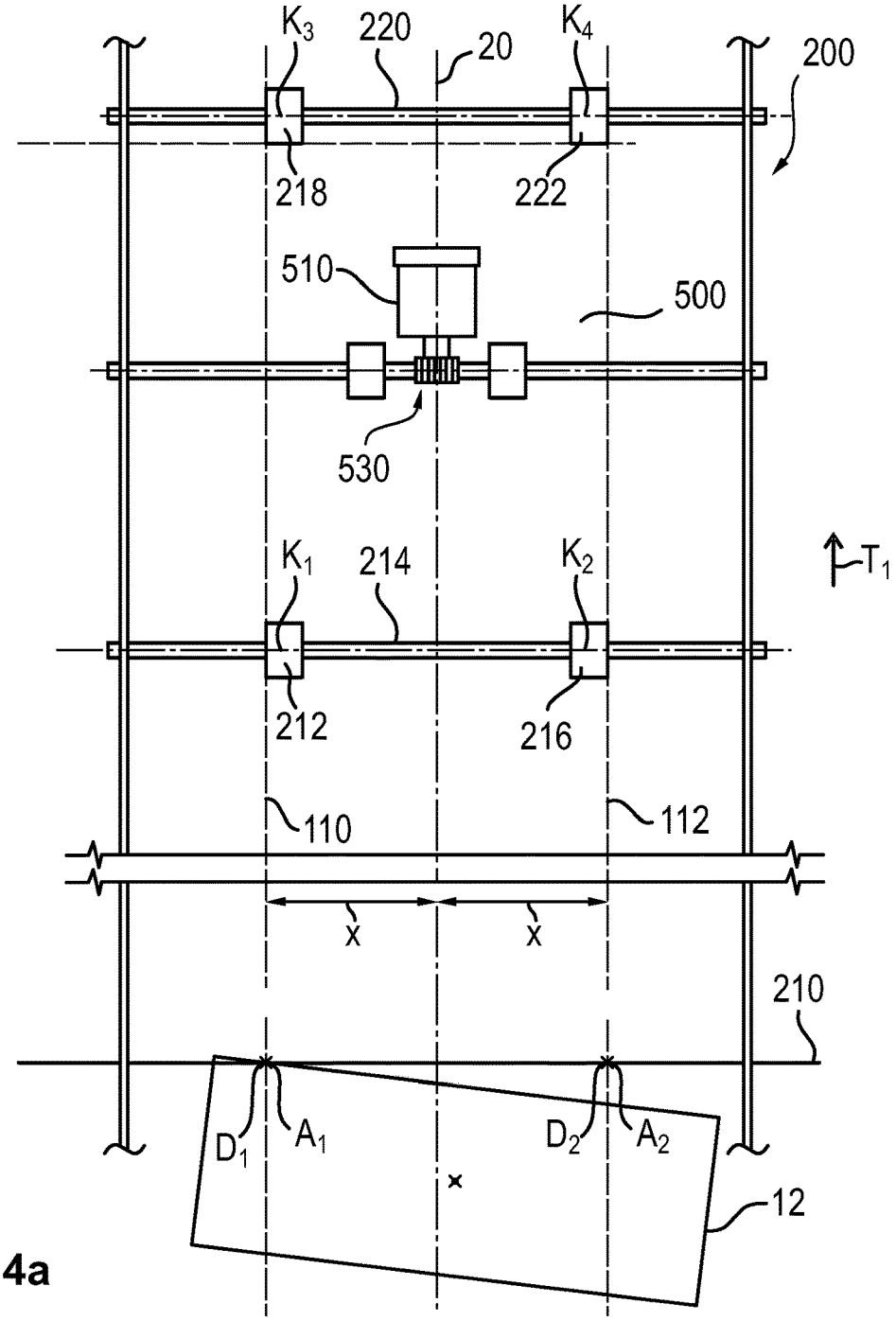
FIG. 4*a* shows a top view of the arrangement for aligning notes of value according to FIGS. 2 and 3.
Figure 4B:
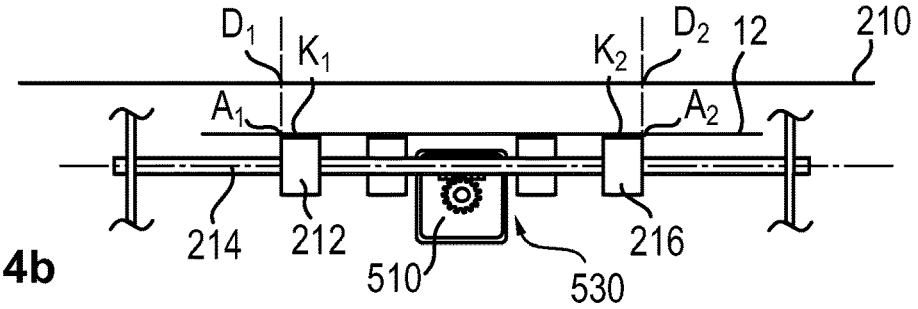
FIG. 4*b* shows a front view of the arrangement for aligning notes of value according to FIG. 4*a;*
Figure 12:
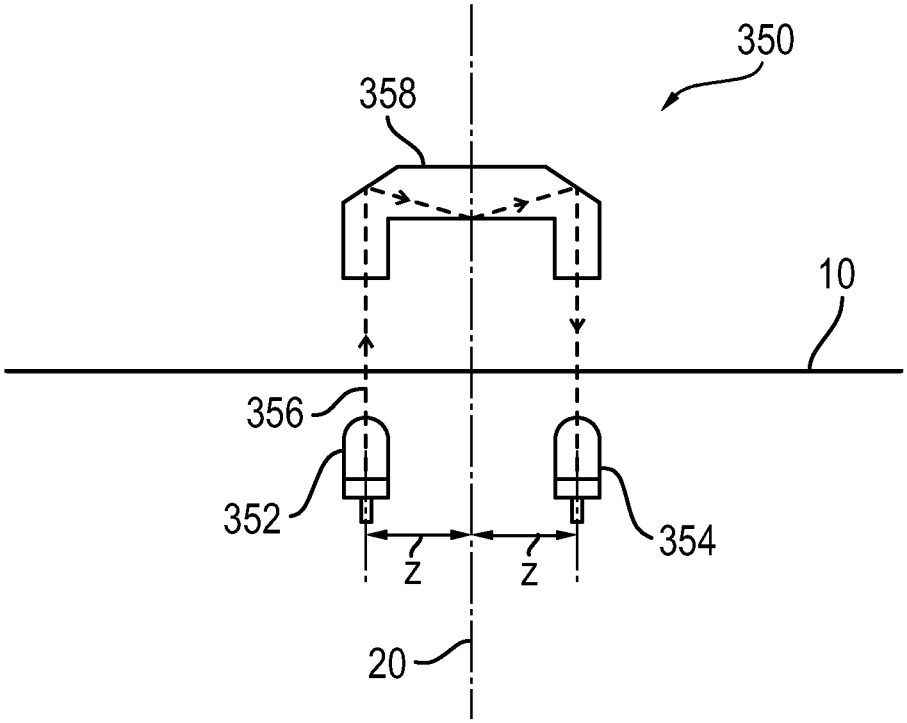
FIG. 12 shows a schematic perspective view of a sensor arrangement which can be used as an alternative to the sensor arrangement shown in FIG. 11.

FIG. 4*a* shows a top view of the arrangement 200 for aligning notes of value 12 to 18 according to FIGS. 2 and 3. FIG. 4*b* shows a front view of the arrangement 200 for aligning notes of value 12 to 18 according to FIG. 4*a*. In FIGS. 4*a* and 4*b* the elements of the aligning apparatus 500 are shown schematically. The aligning apparatus 500 comprises at least one transport element 530 driven by the first drive unit, which is referenced in FIG. 12 schematically at 521 with the driving referenced at 523, and at least one counter pressure element which is arranged opposite the transport element 530 and which is not shown in FIGS. 4*a* and 4*b*. The transport path 10 of the note of value 12 extends between the transport element 530 and the counter pressure element. The counter pressure element is spherical in this embodiment and is mounted in a freely rotatable manner. In further embodiments also other counter pressure elements, in particular rollers, cylinders, belts or deflecting elements, such as deflecting plates, can be used.

Moreover, the aligning apparatus 500 comprises a second drive unit 510 for displacing the transport element 530 along its rotational axis so that a note of value 12 arranged between the transport element 530 and the counter pressure element is moved during displacement of the transport element 530 transversely with regard to the transport direction T1.

As shown in FIG. 4*b*, the scanning line 210 of the bank note reader with the detection areas D1, D2 is arranged at a distance to the transport plane of the transport path 10. The scanning areas A1, A2 lie in the transport plane of the transport path 10. In other embodiments the detection areas D1, D2 can also be arranged in the transport plane of the transport path 10.

Figure 5:
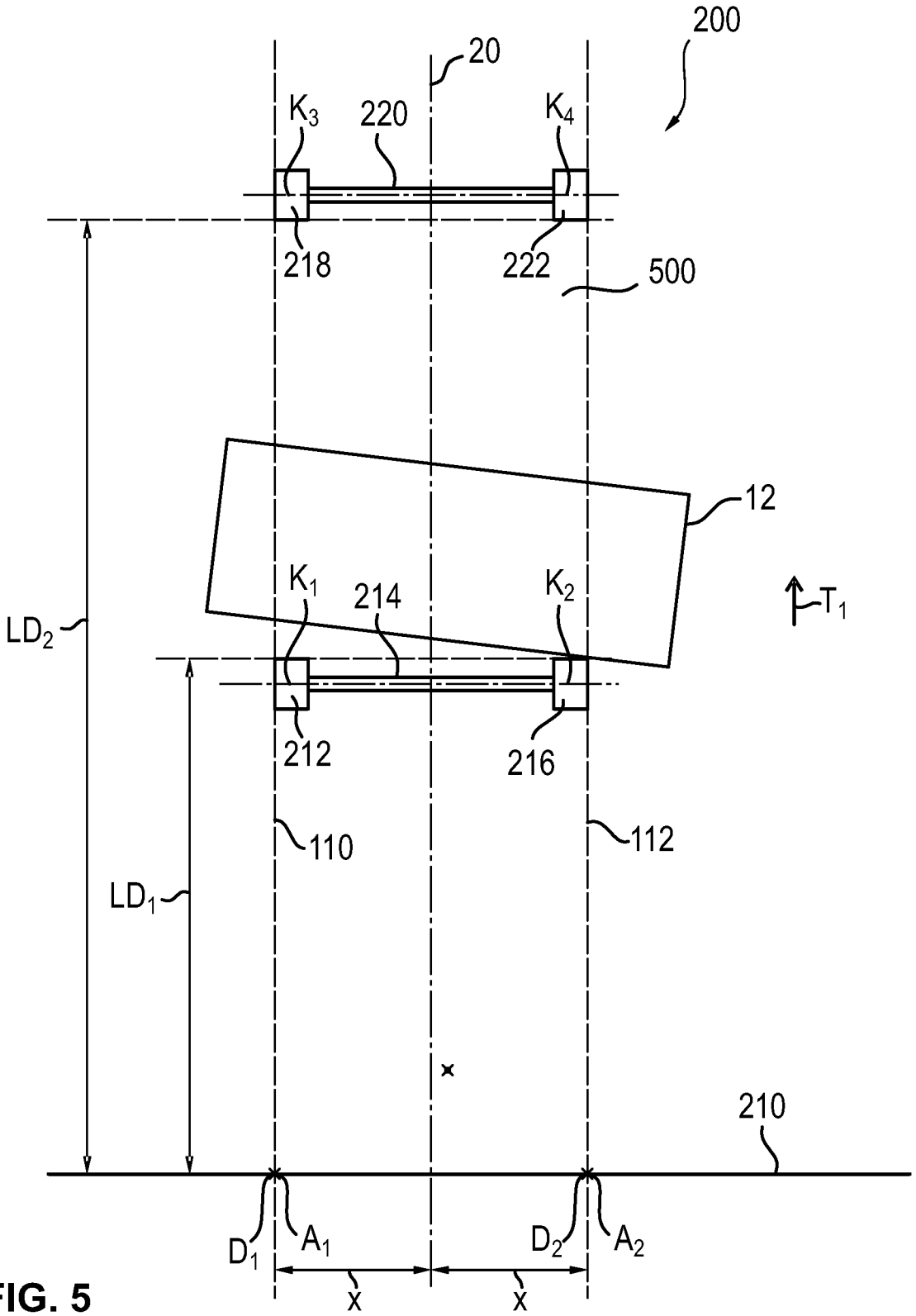
FIG. 5 shows a top view of the arrangement for aligning notes of value according to FIGS. 2 to 4*b;*

FIG. 5 shows a top view of the arrangement 200 for aligning notes of value 12 to 18 according to FIGS. 2 to 4*b*. Starting from the position of the note of value 12 depicted in FIG. 3, this note of value has been transported by means of the first drive unit 521, the first transport element with the rollers 212, 216 and the transport element 530 of the aligning apparatus 500 further in the transport direction T1 to the position shown in FIG. 5. Thus, the trailing edge of the note of value 12 has been transported from the position shown in FIG. 3 across the path length LD1 in the transport direction T1. In the position shown in FIG. 5, the note of value 12 no longer engages the transport rollers 212 and 216 of the first transport element so that the aligning process by means of the aligning apparatus 500 can commence. The aligning process by means of the aligning apparatus 500 is therefore enabled once the note of value 12 has covered the path length LD1.

Figure 6:
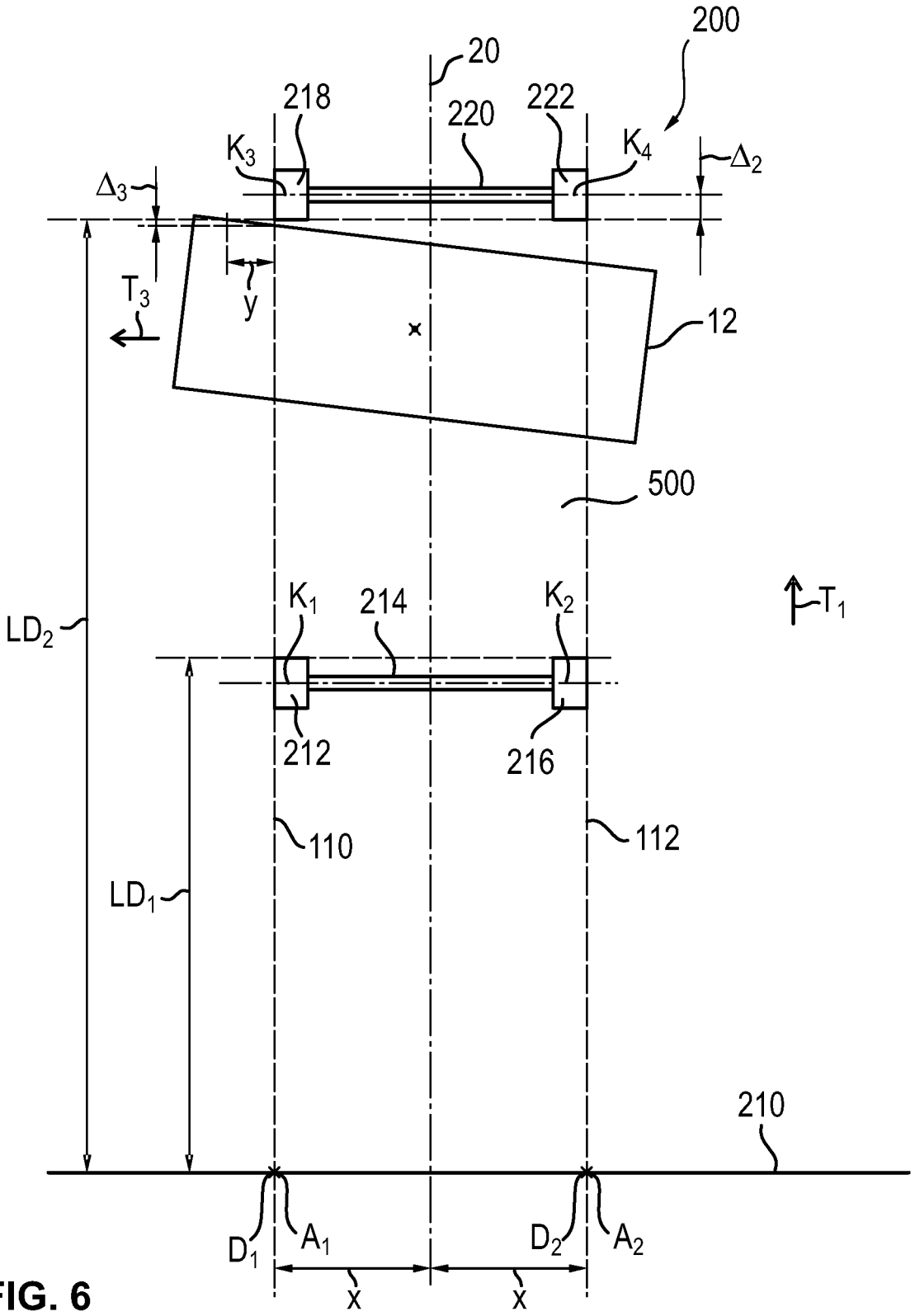
FIG. 6 shows a top view of the arrangement for aligning notes of value according to FIGS. 2 to 5.

FIG. 6 shows a top view of the arrangement 200 for aligning notes of value 12 to 18 according to FIGS. 2 to 5. Starting from the position of the note of value 12 shown in FIG. 2, the leading edge of the note of value 12 has been transported by means of the first drive unit 521, the first transport element and the transport element 530 of the aligning apparatus 500 further in the transport direction T1 across the path length LD2 to the position shown in FIG. 6.

During its transport in the transport direction T1, the note of value 12 has been additionally transported in a transport direction T3 extending transversely with respect to the transport direction T1 across the path length y (a "second distance") by means of the aligning apparatus 500. This displacement transversely to the transport direction T1 enables the point of the leading edge of the note of value 12 that is then aligned with the detection area D1 to be transported across a distance Δ3 (a "third distance") in the transport direction T1 in addition to the path length LD1 before any portion of the note of value 12 reaches the area of the safety distance Δ2 of the transport roller 218. In the depicted embodiment, the distance Δ3 has not been taken into account and the aligning process is terminated by the aligning apparatus 500 at the latest when the note of value 12 has reached the position shown in FIG. 6.

In case the note of value 12 is moved by means of the aligning apparatus 500 in a transport direction opposed to the transport direction T3 across the path length y, the leading edge of the note of value 12 reaches the area of the safety distance Δ2 of the roller 218 as soon as the leading edge of the note of value 12 has been transported across a path length which corresponds to the difference between the transport path length LD2 and the distance Δ3. In the present embodiment however the safety distance Δ2 is dimensioned such that the note of value 12 does not enter the contact area K3 of the roller 218 even if the aligning is terminated only after the leading edge of the note of value 12 has been transported across the path length LD2. In the depicted embodiment, the distance Δ3 has not been taken into account, while in other embodiments, the distance Δ3 can be calculated and the aligning process can be extended or shortened by the distance Δ3 depending on the direction of the aligning in the aligning station 500.

Figure 7:
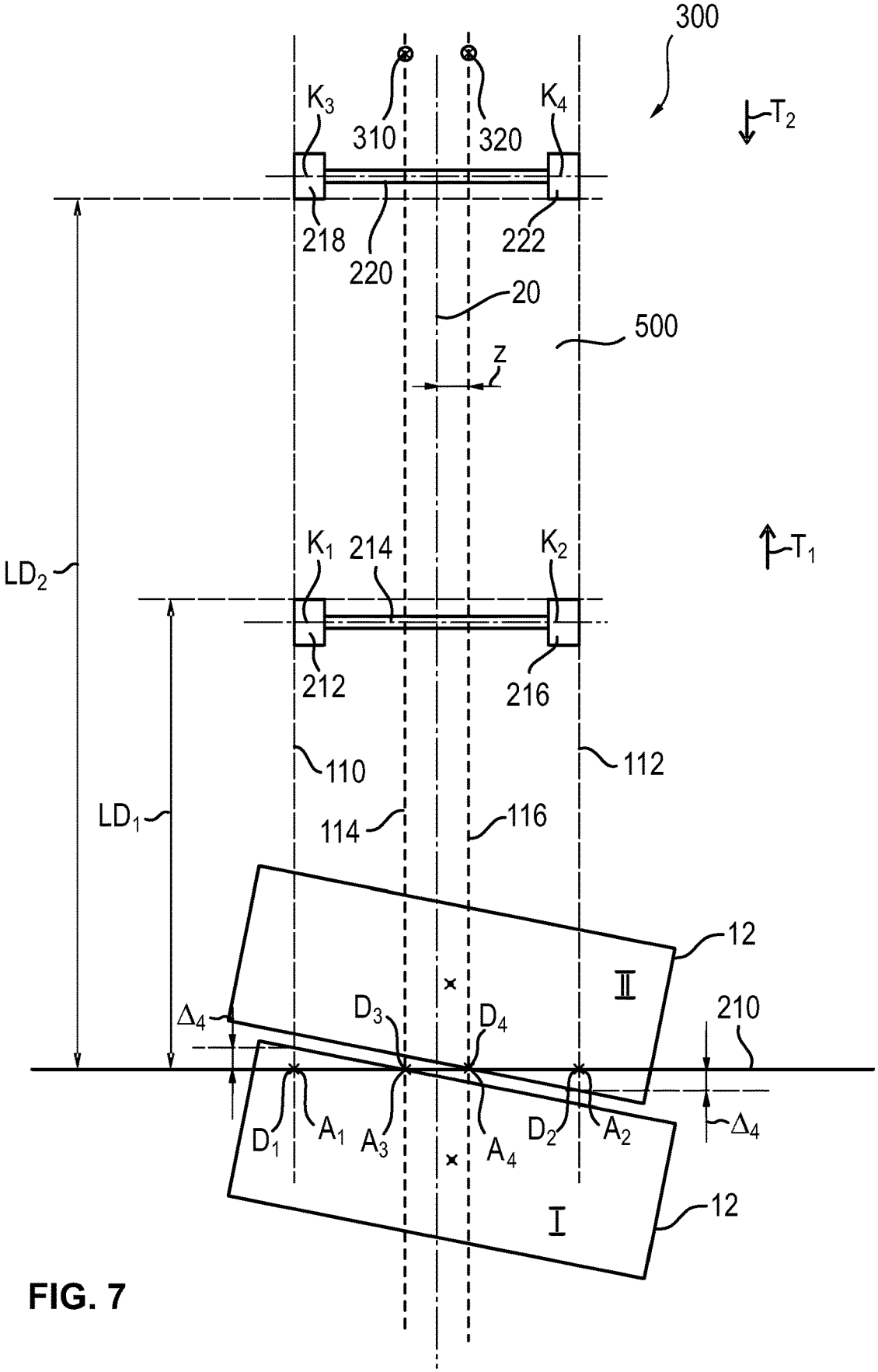
FIG. 7 shows a top view of the arrangement for aligning notes of value according to a second embodiment of the invention.

FIG. 7 shows a top view of an apparatus 300 for aligning notes of value 12 to 18 according to a second embodiment of the invention. As compared to the apparatus 200 according to FIGS. 2 to 6, the apparatus 300 according to FIG. 7 additionally comprises two sensor elements 310 and 320, which are arranged behind the second transport element in the transport direction T1 along an axis 150. The sensor elements 310, 320 each comprise an optical emitter for emitting light and an optical receiver for receiving the light emitted by the emitter. The emitter and receiver are arranged such that while the note of value 12 passes through between the optical emitter and the optical receiver the light beam emitted by the emitter is interrupted. This interruption is detected by the receiver. In the embodiment the two sensor elements 310, 210 are arranged on two opposing sides of the central axis 20 at the same distance z to the central axis. Thus, two known light barrier arrangements, each having one emitter and one receiver, can be used. Alternatively, also a known light sensor arrangement can be used in which the emitter and receiver are arranged on the same side of the transport plane. The light emitted by the emitter is reflected by a reflector element arranged opposite the emitter or deflected by an optical element so that it falls at least partially onto the detector element.

The sensor elements 310, 320 serve to detect the leading edge and the trailing edge of the note of value 12 when the latter passes through the arrangement 300 in a transport direction T2 opposite to the direction T1. The sensor elements 310, 320 each produce a sensor signal upon detecting the leading edge and a sensor signal upon detecting the trailing edge of the note of value 12. The signals produced by the sensor elements 310, 320 are analyzed by the control unit.

In addition to the scanning areas A1 and A2 of the bank note reader, which have already been described, in the arrangement 300 depicted in FIG. 7 two further scanning areas A3 and A4 of the bank note reader are provided. The scanning areas A3 and A4 lie on lines 114 and 116 extending from the sensor elements 300, 320 at a distance z to the central axis. Additionally to the monitoring of the scanning areas A1 and A2 by means of the detection areas D1 and D2 described with regard to FIGS. 2 to 6, a monitoring of the scanning areas A3 an A4 takes place using detection areas D3 and D4.

The detection of the leading edge of the note of value 12 by means of the detection area D3 takes place in the position I of the note of value 12 depicted in FIG. 7 after the note of value 12 has covered a path length Δ4 from the moment of detection of the leading edge of the note of value 12 in the scanning area A1. The path length Δ4 is therefore dependent on the angular offset A of the note of value 12. The detection of the trailing edge of the note of value 12 by the detection area D2 is carried out starting from the position II of the note of value 12 depicted in FIG. 7 after the note of value 12 has covered a path length Δ4 from the moment of detection by means of the detection area D4.

Figure 8:
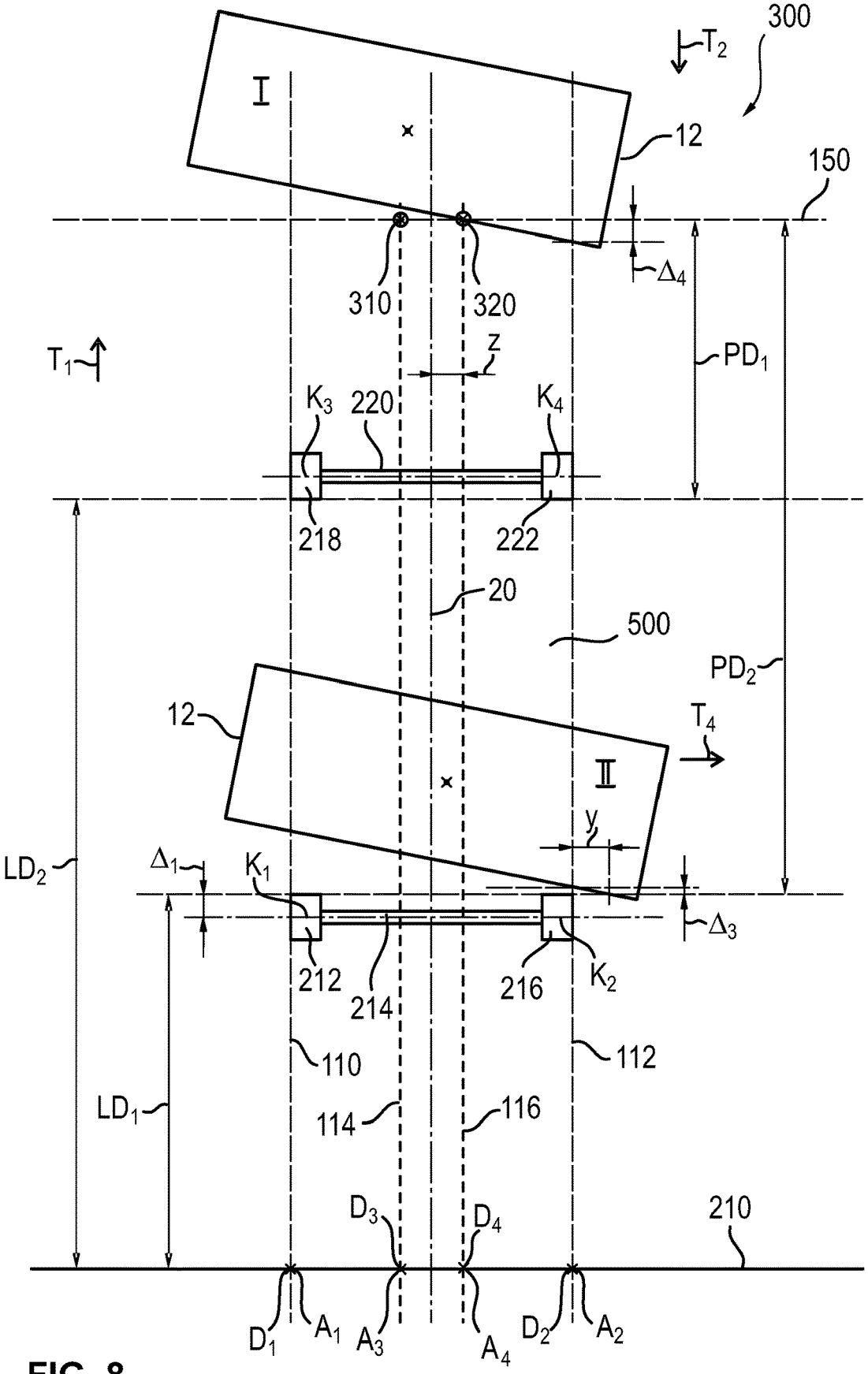
FIG. 8 shows a top view of the arrangement for aligning notes of value according to FIG. 7.

FIG. 8 shows a top view of the arrangement 300 according to FIG. 7. Starting from position I shown In FIG. 7, the note of value 12 has been transported by means of the first drive unit 521, the first transport element, the aligning apparatus 500, the second transport element and by means of further transport elements, which are not shown, In the transport direction T1 until it has passed the sensor elements 310, 320. During this transport, no aligning of the note of value 12 in the aligning device 500 has taken place in the transport direction T1. Subsequently, the note of value 12 has been transported with the help of the transport elements in the direction T2 back to the position I shown in FIG. 8.

The leading edge and the trailing edge are related to the respective transport direction T1, T2, wherein the leading edge is arranged downstream from the trailing edge. Thus, the leading edge of the note of value 12 in FIGS. 2 to 7 becomes the trailing edge of the note of value 12 in FIGS. 8 to 10, and the trailing edge of the note of value 12 in FIGS. 2 to 7 becomes the leading edge of the note of value 12 in FIGS. 8 to 10.

In the position I of the note of value 12 depicted in FIG. 8 the leading edge of the note of value 12 is in the detection area of the sensor element 320 so that the light beam which is emitted by the optical emitter is interrupted. This interruption is detected by the optical receiver of the sensor element 320. In the same manner, the second sensor element 310 detects the leading edge of the note of value 12 when the latter is in the detection area of the sensor element 310. Starting with the first detection of the passage of the leading edge of the note of value 12 through the sensor element 310 or through the sensor element 320 control and/or monitoring of the transport path covered by the leading edge of the note of value 12 in the transport direction T2 by means of the control unit takes place. In particular, the covered transport path is monitored, which determines the termination of the aligning in the aligning apparatus 500. This transport path corresponds to the difference between the path length PD2 and the path length Δ4 discussed with regard to FIG. 7.

The transport path PD2 corresponds to the difference between the distance between the sensor elements 310 and 320 and the contact areas K1 and K2 of the rollers 212 and 216 and the safety distance Δ1, which in the present embodiment corresponds to the radius of the rollers 212 and 216. By means of the safety distance Δ1 it is guaranteed that the aligning of the note of value 12 by means of the aligning apparatus 500 is terminated as soon as the note of value 12 comes into contact with the rollers 212 and 216. In other embodiments other, and in particular smaller, safety distances Δ1 can be used. In the position II depicted in FIG. 8 the leading edge of the note of value 12 has been transported with respect to the position I depicted in FIG. 8 across a path length, which corresponds to the difference between the path length PD2 and the path length Δ4. As explained with regard to FIG. 6, the note of value 12 is moved during transport in the transport direction T1 also additionally in a transport direction T4 transversely to the transport direction T1 across a path length y by means of the aligning apparatus 500. This alignment transversely to the transport direction allows for the leading edge of the note of value 12 to be transported, in addition to the path length corresponding to the difference between LD2 and A4, across a distance Δ3 in the transport direction T1 before it enters the area of the safety distance Δ1 of the transport roller 216. In the depicted embodiment, the distance Δ3 has not been taken into account and the aligning process is terminated by the aligning apparatus 500 in the position II of the note of value 12 depicted in FIG. 8.

Figure 9:
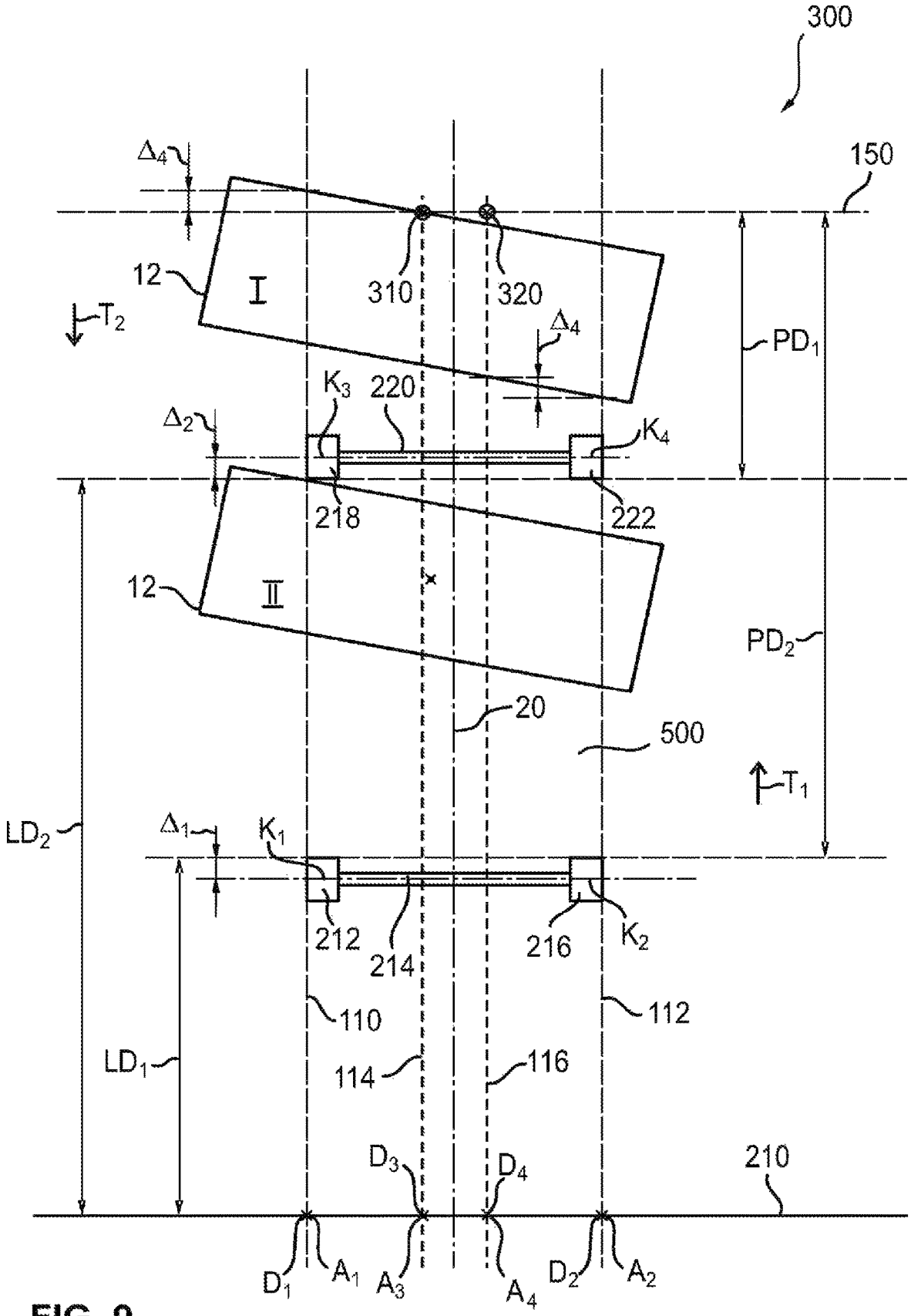
FIG. 9 shows a top view of the arrangement for aligning notes of value according to FIGS. 7 and 8.

FIG. 9 shows a top view of the arrangement 300 for aligning notes of value 12 to 18 according to FIGS. 7 and 8. In the position I of the note of value 12 shown in FIG. 9 the trailing edge of the note of value 12 has exited the detection area of the sensor element 310 so that the light beam emitted by the optical emitter again reaches the optical receiver after the light beam had been interrupted during the passage of the note of value 12. The passage of the trailing edge of the note of value 12 through the sensor element 320 happened already at an earlier point in time in the depicted position I of the note of value so that the light beams of both sensor elements 310 and 320 are received again by the optical receivers. Commencing with the detection of the light beam by the receiver of the sensor element 310, control and/or monitoring of the transport path covered by the trailing edge of the note of value 12 in the transport direction T2 takes place. In particular the transport of the note of value 12 across a path length is monitored which corresponds to the sum of a path length PD1 and the path length Δ4.

The path length PD1 corresponds to the sum of the distance between the sensor elements 310, 320 and the contact areas K1 and K2 of the rollers 218 and 222 and a safety distance Δ2, which in the present embodiment corresponds to the radius of the rollers 218 and 222. By means of the safety distance Δ2 it is guaranteed that the note of value 12 is no longer in contact with the rollers 218 and 222 when the aligning by means of the aligning apparatus 500 commences so that the aligning apparatus 500 can commence the aligning process of the note of value 12 without problems. In other embodiments other, and in particular shorter, safety distances Δ2 can be used.

In the position II of the note of value 12 depicted in FIG. 9 the note of value has been transported with regard to position I depicted in FIG. 9 across a path length, which corresponds to the sum of the path lengths PD1, and Δ4. The aligning by means of the aligning apparatus 500 commences.

Figure 10:
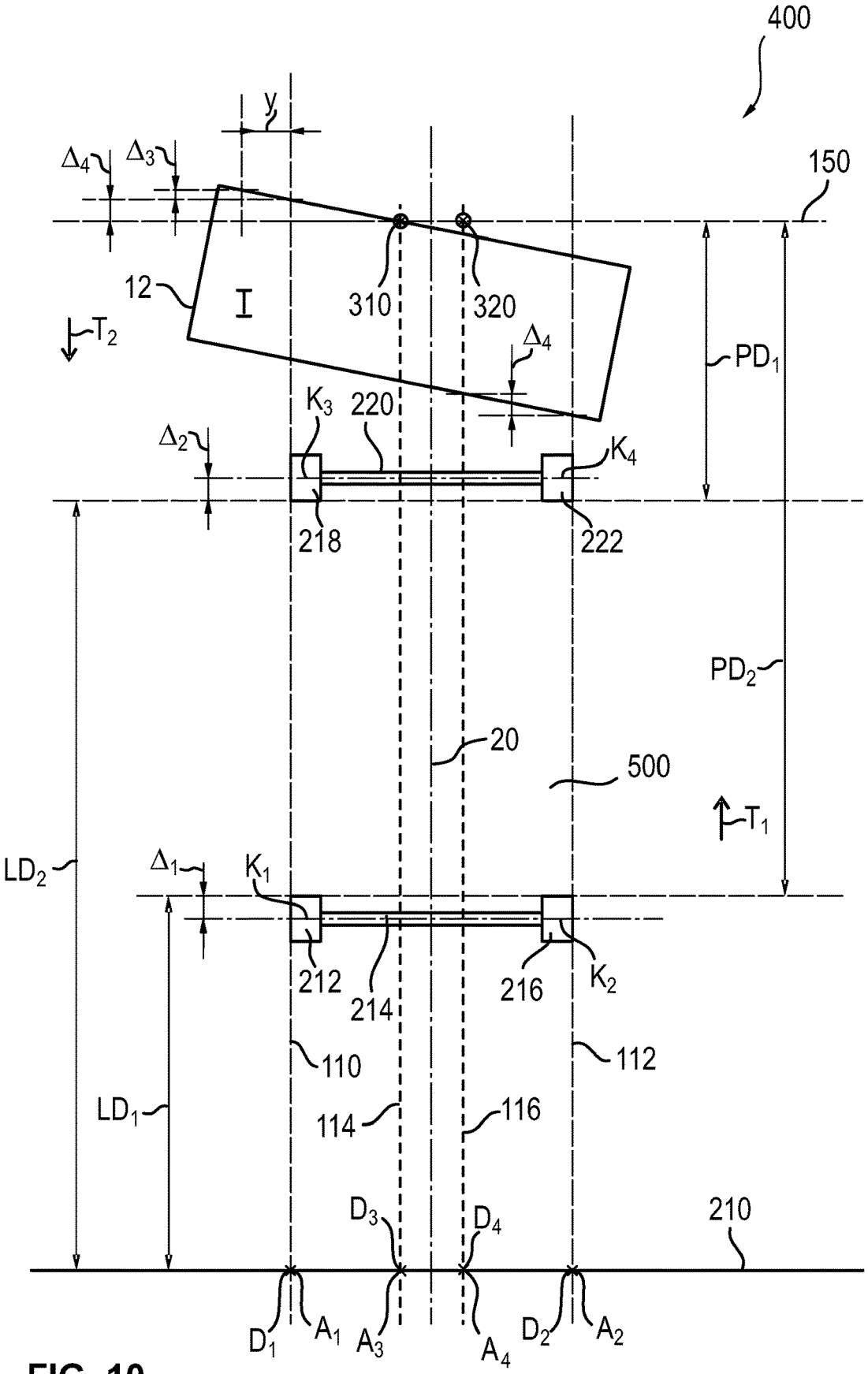
FIG. 10 shows a top view of the arrangement for aligning notes of value according to a third embodiment of the invention.

FIG. 10 shows a top view of an arrangement 400 for aligning notes of value 12 to 18 according to a third embodiment of the invention. An aligning of the note of value 12 has been carried out by means of the aligning apparatus 500 in the transport direction T1, as explained with regard to FIG. 6. After the aligning, the note of value 12 has been transported by means of the second transport element and further transport elements, which are not depicted, in the transport direction T1 until it passed the sensor elements 310, 320, and it has been subsequently transported back by means of the transport elements in the direction T2 to the position depicted in FIG. 10.

In the position of the note of value 12 depicted in FIG. 10 the trailing edge of the note of value 12 has exited the detection area of the sensor element 310 so that, in accordance with the explanations with regard to FIG. 9, control and/or monitoring of the transport path covered by the trailing edge of the note of value 12 in the transport direction T2 commences. In particular the transport of the trailing edge of the note of value 12 across a path length is monitored which corresponds to the sum of the path lengths PD1, A4 and A3. The path length PD1 has been explained in connection with FIG. 9, the path length Δ4 in connection with FIG. 7, and the path length Δ3 in connection with FIG. 6. As opposed to the first embodiment of the invention according to FIG. 6, in which the path length Δ3 was not taken into account, in the present embodiment the path length Δ3 is determined and the aligning of the note of value 12 by means of the aligning apparatus 500 commences as soon as the trailing edge of the note of value 12 has been transported across a path length which corresponds to the sum of the path lengths PD1, Δ3 and Δ4.

Control and/or monitoring of the leading edge of the note of value 12 commences in accordance with the explanations made in connection with FIG. 8, as soon as the leading edge of the note of value 12 is in the detection area of the sensor element 320 or 310. Commencing with the first detection of the leading edge of the note of value 12 by the sensor element 310 or by the sensor element 320 the passage across the path length is monitored which determines the termination of the possible aligning in the aligning apparatus 500. This path length corresponds to the difference between the path length PD2 and the sum of the path lengths Δ4 and Δ3, wherein the path length PD2 has been explained in connection with FIG. 8.

Figure 11:
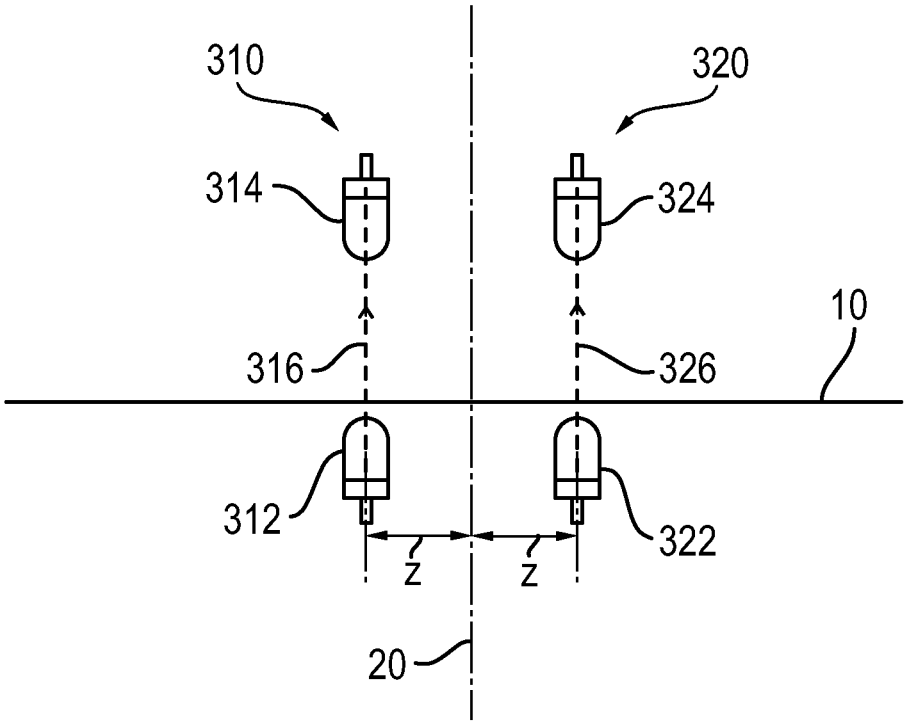
FIG. 11 shows a side view of two sensor elements of the arrangement for aligning notes of value according to FIGS. 7 to 10.

FIG. 11 shows a side view of a sensor arrangement with sensor elements 310 and 320 as used in the arrangements 300, 400 for aligning notes of value 12 to 18 according to FIGS. 7 to 10. The two sensor elements 310, 320 are arranged on two opposite sides of the central axis 20 with the same distance z to the central axis 20. The sensor elements 310, 320 comprise each an optical emitter 312, 322 for emitting a light beam 316, 326 and an optical receiver 314, 324 for receiving at least part of the light beam 316, 326 emitted by the emitter. The emitter 312, 322 and the receiver 314, 324 are arranged such that during the passage of the note of value 12 between the optical emitter 312, 322 and the optical receiver 314, 324 the light beam 316, 324 emitted by the emitter 312, 322 is interrupted.

While the leading edge of the note of value 12 passes through the sensor element 320 in accordance with the position I of the note of value 12 shown in FIG. 8, the light beam 326 is interrupted. As described in connection with FIG. 8, the receiver 324 detects this event so that commencing with this first detection control and/or monitoring of the transport path covered by the leading edge of the note of value 12 in the transport direction T2 takes place.

When the note of value 12 is in the position I shown in FIG. 9, the trailing edge of the note of value 12 has exited the sensor element 310 so that the light beam 316 is detected again by the receiver 314, after said light beam had been interrupted during the passage of the note of value 12. The passage of the trailing edge of the note of value 12 through the sensor element 322 happened already at an earlier point in time so that commencing with the second detection by the receiver 314 the control and/or monitoring of the transport path covered by the trailing edge of the note of value 12 in the transport direction T2 takes place, as already described in connection with FIG. 9.

FIG. 12 shows a schematic perspective view of a further sensor arrangement 350, which can be used in the arrangements 300, 400 as an alternative to the sensor arrangement shown in FIG. 11. This sensor arrangement 350 comprises an optical emitter 352 for emitting a light beam 356, an optical receiver 354 for receiving the light beam 356 and a prism arrangement 358 for deflecting the light beam 356, wherein the emitter 352 and the receiver 354 are arranged on the same side of the transport path 10 and the prism arrangement 358 is arranged on the opposite side of the transport path 10. The emitter 352 and the receiver 354 are arranged on two opposite sides of the central axis 20 with the same distance z to the central axis 20. The prism arrangement 358 deflects the light beam 356 emitted by the emitter 352 so that at least part of it reaches the optical receiver 354. When the note of value 12 is located between the optical emitter 352 and the prism arrangement 358, the light beam 356 is interrupted. The light beam 356 is also interrupted, when the note of value 12 is located between the receiver 354 and the prism arrangement 358.

In case in a further embodiment of the invention the sensor elements 310 and 320 according to the embodiment depicted in FIGS. 7 to 10 are replaced by the sensor arrangement 350, wherein the emitter 352 is put in the position of the emitter 312 and the receiver 354 is put in the position of the emitter 322, and the note of value 12 is in the position I shown in FIG. 8, the receiver 354 can detect that the leading edge of the note of value 12 passes through the sensor element 350. The receiver 354 cannot detect whether the light beam 356 is interrupted in the emission area of the emitter 352 or in the receiving area of the receiver 354. During the passage of the leading edge of the note of value 12 through the receiver 354 it is known however, whether the trailing edge of the note of value 12 passes through the sensor arrangement at an angel A or −A. This information regarding the orientation of the angular offset A is detected during the passage of the leading edge of the note of value 12 through the bank note reader, and a corresponding information is transferred to the control unit. With the interruption of the light beam 356 the control and/or monitoring of the transport path covered by the leading edge of the note of value 12 commences. In particular, the transport of the leading edge of the note of value 12 across a path length corresponding to the sum of the path lengths PD2 and Δ4 is monitored, as explained in connection with FIG. 8.

The light beam 356 reaches the receiver 354 again as soon as the trailing edge of the note of value 12 has exited both the emitting area of the emitter 352 and the receiving area of the receiver 354, after the light beam 356 had been interrupted during the passage of the note of value 12. The receiver 354 cannot detect whether the light beam 356 has been unblocked in the emitting area of the emitter 352 or in the receiving area of the receiver 354. During the passage of the trailing edge of the note of value 12 through the receiver 354 it is however known, whether the trailing edge of the note of value 12 passes through the sensor arrangement 350 at an angle A or −A. This information regarding the orientation of the angular offset A is detected during the passage of the note of value 12 through the bank note reader and a corresponding information is transferred to the control unit. With the detection of the light beam 356 by the receiver 354 the control and/or monitoring of the transport path covered by the trailing edge of the note of value 12 commences. In particular, the transport of the trailing edge of the note of value 12 across a path length corresponding to the sum of the path lengths PD1 and A4 is monitored, as has been explained in connection with FIG. 9.

Figure 13:
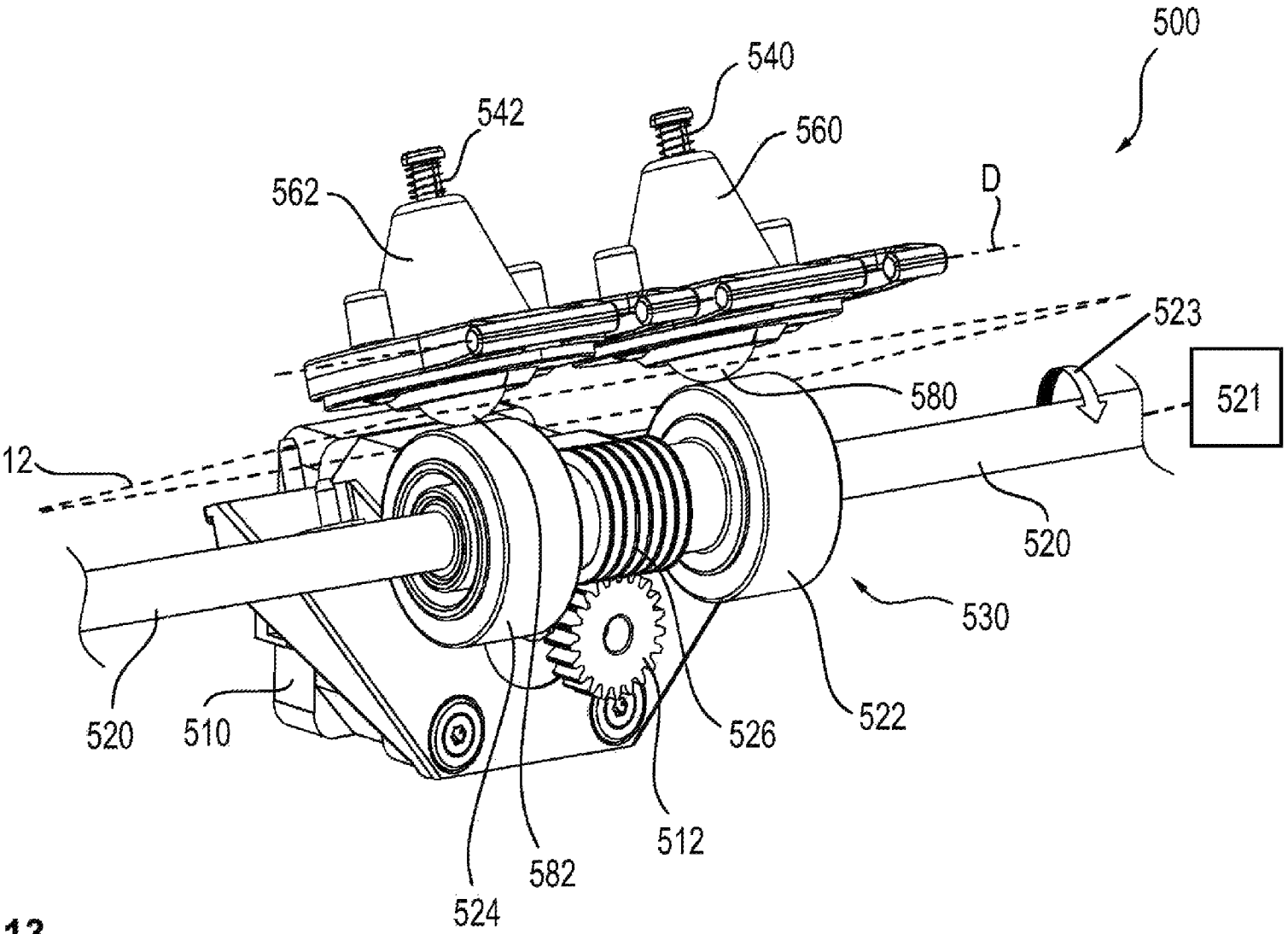
FIG. 13 shows a schematic perspective view of an aligning apparatus for use in an arrangement according to FIGS. 2 to 10.

FIG. 13 shows a schematic perspective view of an alignment apparatus 500 for use In an arrangement 200, 300, 400 according to FIGS. 2 to 10. The apparatus 500 comprises a transport element 530 with the rollers 522 and 524 and with a connecting element 526, a drive shaft 520, which is driven via the first drive unit 521, and the second drive unit 510 which drives a gear wheel 512, which engages a peripheral toothing of a connecting element 526. The rotation of the gear wheel 512 effects an axial displacement of the transport element 530 on the drive shaft 520 along the rotational axis of the drive shaft or along the rotational axis of the rollers 522 and 524 of the rotational axis of the transport element 530.

Furthermore, the apparatus 500 comprises two spherical counter pressure elements 580 and 582 which are each arranged opposite a corresponding roller 522 and 524 of the transport element 530 and which are each mounted on a bearing unit 560 and 562 in a freely rotatable manner. The bearing units 560 and 562 each engage with an elastically deformable element 540 and 542, by means of which a pressure force of the spherical counter pressure elements 580 and 582 acts onto a note of value 12 arranged between the transport element 530 and the counter pressure elements 580 and 582.

When during its transport along the transport path 10 a note of value 12 is located between the roller 522, 524 of the transport element 530 and the counter pressure elements 580, 582, said note of value is pressed by means of the counter pressure elements 580, 582 against the lateral surface of the rollers 522, 524. During the rotation of the transport element 530 via the drive shaft 520, the rollers 522, 524 of the transport element 530 are displaced axially on the drive shaft 520 by means of the second drive unit 510 so that the note of value 12 is transported through the aligning apparatus 500 obliquely with regard to the transport direction T1.

What is claimed is:

1. An apparatus for aligning at least one note of value along a transport path, comprising:

at least one bank note reader, which has at least one scanning line with at least first and second detection areas along the scanning line for scanning the at least one note of value, wherein each of the at least first and second detection areas scans respective scanning areas in a transport plane of the transport path, wherein the first detection area detects a first point along a leading edge of the at least one note of value, and wherein the respective scanning areas are arranged along the at least one scanning line orthogonally with respect to a central axis of the transport path;

a first transport element and at least one second transport element for transporting the at least one note of value along the transport path in a first transport direction along the central axis, wherein the first and the at least one second transport elements each contact the at least one note of value in respective contact areas, wherein the first and the at least one second transport elements include respective first and second contact elements, each of the first and second contact elements being a roller, and wherein the first and the at least one second transport elements are downstream of the at least one scanning line along the transport path;

at least one aligning apparatus for aligning the at least one note of value, which at least one aligning apparatus is arranged between the first transport element and the at least one second transport element along the transport path and forms a section of the transport path;

wherein the at least one bank note reader detects a trailing edge of the at least one note of value in a first scanning area of the respective scanning areas and in a second scanning area of the respective scanning areas, the first scanning area is on a first side of the central axis the same lateral distance to the central axis of the transport path as a first contact area of the contact areas of the second transport element;

wherein the second scanning area is on a second side of the central axis opposite the first side the same lateral distance to the central axis of the transport path as a second contact area of the contact areas of the second transport element;

wherein that commencing with the detection of the exit of the trailing edge of the at least one note of value from the first scanning area and the second scanning area, a control unit controls the transport of the at least one note of value in the first transport direction and the at least one aligning apparatus in such a way that the at least one aligning apparatus commences an aligning process only after the at least one note of value has been transported across a preset first path length in the first transport direction;

wherein the control unit controls the at least one aligning apparatus to execute an aligning process on the at least one note of value over a first distance along the transport path, the first distance equal to a distance between the respective contact areas of the first and at least one second transport elements less a first safety distance equal to a radius of the roller of the first contact element and also less a second safety distance equal to a radius of the roller of the second contact element; and wherein that during transport of the at least one note of value in the first transport direction along the first distance, the at least one note of value is additionally transported in a second transport direction extending transversely with respect to the first transport direction across the transport path, the at least one note of value transported a second distance by the at least one aligning apparatus whereby the displacement of the at least one note of value transversely to the first transport direction results in alignment of a second point of the leading edge of the at least one note of value with the first detection area and the roller of the second contact element and the second point being a third distance along the central axis from the roller of the second contact element when the first point has traveled the first distance.

2. The apparatus according to claim 1 wherein the first path length corresponds to a distance between the scanning line of the at least one bank note reader and the contact area of the first transport element for contact with the at least one note of value during its transport along the transport path plus the first safety distance.

3. The apparatus according to claim 1 wherein the at least one bank note reader detects a position of the at least one note of value, wherein the at least one bank note reader or a control unit determines a lateral offset with respect to a preset target position, wherein the aligning of the at least one note of value is carried out by the aligning apparatus being controlled in dependence on the determined lateral offset such that it reduces or corrects the lateral offset.

4. The apparatus according to claim 1 wherein the at least one aligning apparatus further comprises:

at least one transport element including first and second rollers;

at least one first drive unit configured to drive the at least one transport element in rotation about a rotation axis to thereby transport the at least one note of value in the first transport direction along the transport path; and a second drive unit which, when activated, moves the at least one note of value additionally in the second direction.

5. The apparatus according to claim 4 wherein the second drive unit, when activated, moves the at least one transport element along the rotation axis.

6. The apparatus according to claim 4 wherein, when the at least one first drive unit and the second drive unit are activated simultaneously, the aligning apparatus moves the at least one note of value obliquely with respect to the first transport direction.

7. The apparatus according to claim 1 wherein rotation of the first and at least one second transport elements is reversible so that bidirectional passage of the at least one note of value through the apparatus is possible in the first transport direction and in a third transport direction opposite to the first transport direction.

8. A method for aligning at least one note of value along a transport path centered on a central axis comprising:

scanning the at least one note of value with at least one scanning line of at least one bank note reader, wherein the at least one scanning line has a plurality of respective detection areas, wherein each detection area scans a respective scanning area in a transport plane of the transport path, wherein the scanning areas are arranged along the at least one scanning line extending orthogonally with respect to the central axis of the transport path;

transporting the at least one note of value with a first transport element and with at least one second transport element along the transport path in a first transport direction, wherein the first and at least one second transport elements each contact the at least one note of value in respective contact areas;

moving the at least one note of value with at least one aligning apparatus which is arranged between the first transport element and the at least one second transport element;

forming a section of the transport path with the at least one aligning apparatus;

detecting, with the at least one scanning line of the at least one bank note reader, a trailing edge of the at least one note of value at a first scanning area of the scanning areas and in a second scanning area of the scanning areas;

positioning a first detection area of the plurality of detection areas on a first side of the central axis the same lateral distance to the central axis of the transport path as a first contact area of the contact areas of the second transport element;

detecting a first point along a leading edge of the at least one note of value with the first detection area when the at least one note of values passes across the at least one scanning line;

positioning a second detection area of the plurality of detection areas on a second side of the central axis opposite the first side the same lateral distance to the central axis of the transport path as a second contact area of the contact areas of the second transport element;

wherein said moving the at least one note of value with the at least one aligning apparatus includes controlling the at least one aligning apparatus, with a control unit, commencing with the detection of the exit of the trailing edge of the at least one note of value from the first scanning area and the second scanning area, the transport of the at least one note of value in the first transport direction by the at least one aligning apparatus in such a way that:

the at least one aligning apparatus commences an aligning process on the at least one note of value only after the at least one note of value has been transported across a preset first path length in the first transport direction, the aligning process is executed on the at least one note of value over a first distance along the transport path, the first distance equal to a distance between the respective contact areas of the first and second contact areas less a first safety distance equal to a radius of the roller of the first contact element and also less a second safety distance equal to a radius of the roller of the second contact element, during transport of the at least one note of value in the first transport direction along the first distance by the at least one aligning apparatus, the at least one note of value is additionally transported in a second transport direction extending transversely with respect to the first transport direction across the transport path, the at least one note of value transported a second distance by the at least one aligning apparatus whereby the displacement of the at least one note of value transversely to the first transport direction results in alignment of a second point of the leading edge of the at least one note of value with the first detection area and the roller of the second contact element and the second point being a third distance along the central axis from the roller of the second contact element when the first point has traveled the first distance.

* * * * *